US007815444B2

(12) United States Patent
Minich

(10) Patent No.: US 7,815,444 B2
(45) Date of Patent: Oct. 19, 2010

(54) LOW PROFILE ELECTRICAL CONNECTOR

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/737,003

(22) Filed: Apr. 18, 2007

(65) Prior Publication Data

US 2008/0261417 A1 Oct. 23, 2008

(51) Int. Cl.
*H01R 12/00* (2006.01)

(52) U.S. Cl. ..... 439/79; 439/374

(58) Field of Classification Search ..... 439/74, 439/79, 80, 78, 83, 608, 374, 701, 607.07, 439/607.06

See application file for complete search history.

(56) References Cited

U.S. PATENT DOCUMENTS 4,583,807 A * 4/1986 Kaufman et al. ..... 439/83
4,628,410 A * 12/1986 Goodman et al. ..... 361/789
4,907,978 A 3/1990 Bowen ..... 439/79
5,593,307 A * 1/1997 Bale et al. ..... 439/79
5,772,452 A 6/1998 Aoyama ..... 439/74
6,068,494 A 5/2000 Tokuwa ..... 439/79
6,093,031 A 7/2000 Longueville
6,171,149 B1 * 1/2001 van Zanten ..... 439/608
6,183,301 B1 * 2/2001 Paagman ..... 439/608
6,227,873 B1 * 5/2001 Tung ..... 439/79
6,231,391 B1 * 5/2001 Ramey et al. ..... 439/608
6,639,806 B1 * 10/2003 Chuang et al. ..... 361/748
6,663,426 B2 * 12/2003 Hasircoglu et al. ..... 439/608
6,979,215 B2 12/2005 Avery et al.
7,094,102 B2 8/2006 Cohen et al. ..... 439/608

OTHER PUBLICATIONS

Berg Electronics Catalog, Shrouded Headers, Right-Angle 2-Row Guide Pin Header BergCon System, Mar. 1995, 950500-1, pp. 13-70 thru 13-79, 23-0 thru 23-1.

* cited by examiner

*Primary Examiner*—Xuong M Chung-Trans
(74) *Attorney, Agent, or Firm*—Woodcock Washburn LLP

(57) ABSTRACT

A right-angle electrical connector is disclosed. The right-angle electrical connector may include an electrically conductive contact and a connector housing that contains the electrically conductive contact. The electrically conductive contact may define a mounting end and a mating end. The connector housing may include a mating portion and a guide portion. The mating portion may receive the mating end of the electrically conductive contact. The mating portion may define a mating plane. The guide portion may be connected to the mating portion and may define a guide plane orthogonal to the mating plane. The guide portion may extend beyond the mating portion. The mating portion may also define a mounting plane. The mounting plane may be orthogonal to the mating plane. The guide portion may define a void between the guide plane and the mounting plane, suitable for receiving a header wall of a complementary connector.

20 Claims, 5 Drawing Sheets

LOW PROFILE ELECTRICAL CONNECTOR

BACKGROUND

Electrical devices may be implemented with more than one circuit board. Right angle electrical connectors may be used to establish a conductive connection between circuit boards, as in coplanar and back-panel configurations, for example. Typically, the size and position of the right angle connector may limit the physical arrangement of circuit boards within the device.

In electrical devices where physical space is limited, it may be desirable to limit the height of the right angle connector. For example, in backplane applications within a fixed chassis, a smaller height may minimize the distance between circuit boards and ultimately increase the number of circuit boards included within the chassis.

Typically, the connector housing may be a component of the overall connector height. For example, the thickness and shape of the housing walls may, in part, define the connector height. Generally, the thickness and shape of the housing walls may provide physical guidance when mating electrical connectors. For example, the housing walls may be keyed to allow for mating in only one orientation.

Thus, there is a need for an electrical connector housing that minimizes connector height while still providing guidance for mating.

SUMMARY

A right-angle electrical connector may include an electrically conductive contact and a connector housing that contains the electrically conductive contact. The electrically conductive contact may define a mounting end and a mating end. The connector housing may include a mating portion and a guide portion. The mating portion may receive the mating end of the electrically conductive contact. The mating portion may define a mating plane. The guide portion may be connected to the mating portion and may define a guide plane perpendicular to the mating plane. The guide portion may extend beyond the mating portion.

The mating portion may also define a mounting plane. The mounting plane may be perpendicular to the mating plane. The guide portion may define a void between the guide plane and the mounting plane. The void may be suitable for receiving a header wall of a complementary connector. When the right-angle connector is mounted to an upper surface of a substrate, the guide portion may define a receiving channel between the guide portion and the upper surface of the substrate.

DETAILED DESCRIPTION

Figure 1:
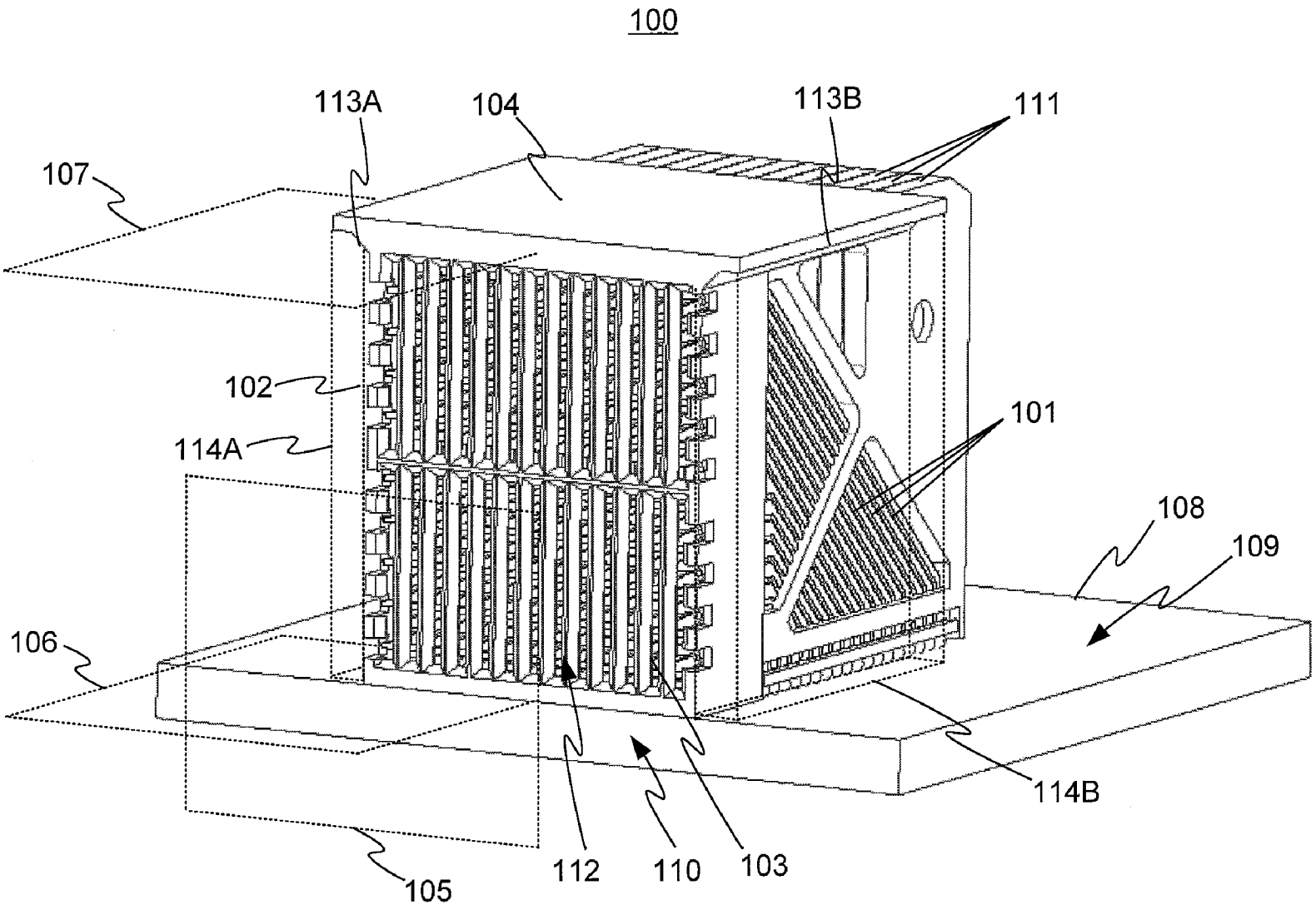
FIG. 1 depicts an isometric view of a right-angle electrical connector mounted to a substrate.

FIG. 1 depicts an isometric view of a right-angle electrical connector 100 mounted to a substrate 108. The right-angle electrical connector 100 may be mounted to an upper surface 109 of the substrate 108. The substrate 108 may be a circuit board, for example.

The right-angle electrical connector 100 may include a connector housing 102 and one or more electrically conductive contacts 101. The connector housing 102 may be made of a dielectric material, such as plastic for example. The connector housing 102 may be injection molded.

The connector housing 102 may define a mating end 103. The mating end 103 may be suitable for mating with a complementary connector (See FIG. 3). The mating end 103 may define a mating plane 105 and a mounting plane 106 that is perpendicular to the mating plane 105. For example, the mating plane 105 may be defined by a mating face 112 of the connector housing 102 designated for mating with a complementary connector. Also for example, the bottom surface (not shown) of the mating end 103 may define the mounting plane 106. When the right-angle electrical connector is mounted to the substrate 108, the mounting plane 106 may be flush with the upper surface 109 of the substrate 108.

The right-angle electrical connector 100 may be mounted such that the mating plane 105 defined by the mating end 103 of the connector housing 102 may be flush with the edge 110 of the substrate 108. The substrate 108 may protect the right-angle electrical connector 100 from damage during handling.

The mating end 103 of the connector housing 102 may have connected thereto a guide portion 104. The guide portion 104 may extend beyond the mating end 103 of the connector housing 102. For example, the guide portion 104 may extend beyond either side of the mating end 103 of the connector housing 102. The bottom edges 113A-B of the guide portion 104 may be chamfered. When the connector is mounted to the substrate 108, the guide portion 104 may define one or more voids 114A-B between the guide portion 104 and the upper surface 109 of the substrate 108. The guide portion 104 may define a guide plane 107. The voids 114A-B may be defined between the guide plane 107 and the mounting plane 106. The connector housing 102 may contain one or more molded leadframe assemblies, such as insert molded leadframe assemblies (IMLAs) 111.

Figure 2A:
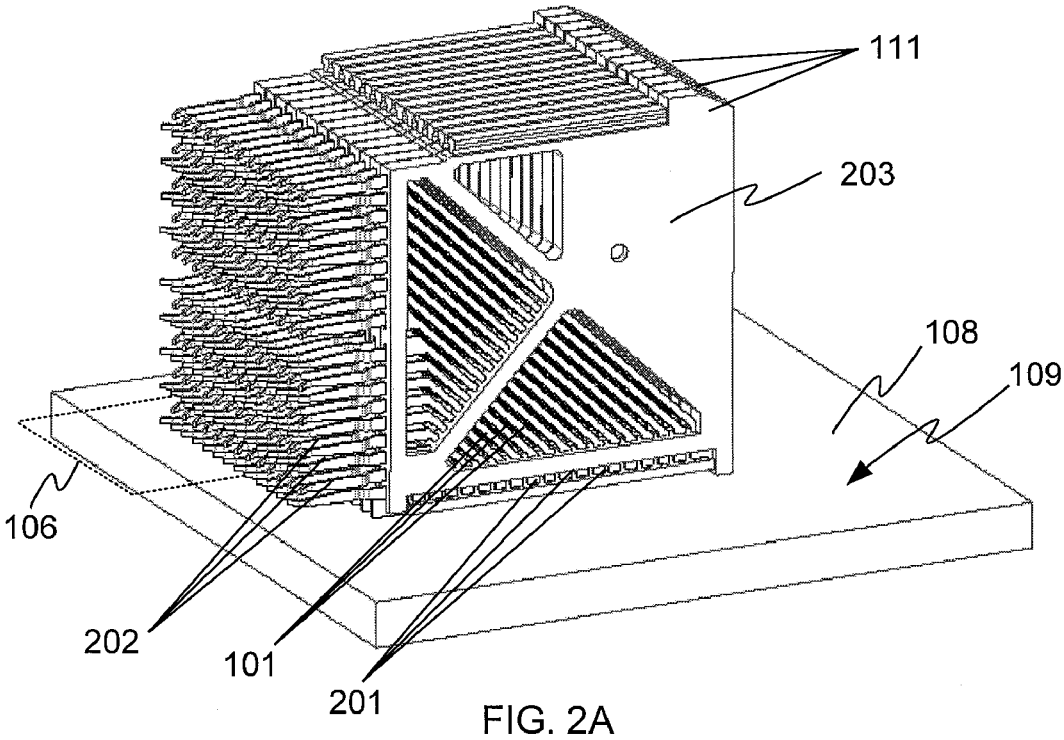
FIGS. 2A and 2B depict a plurality of insert molded leadframe assemblies mounted to a substrate in isometric and side views, respectively.
Figure 2B:
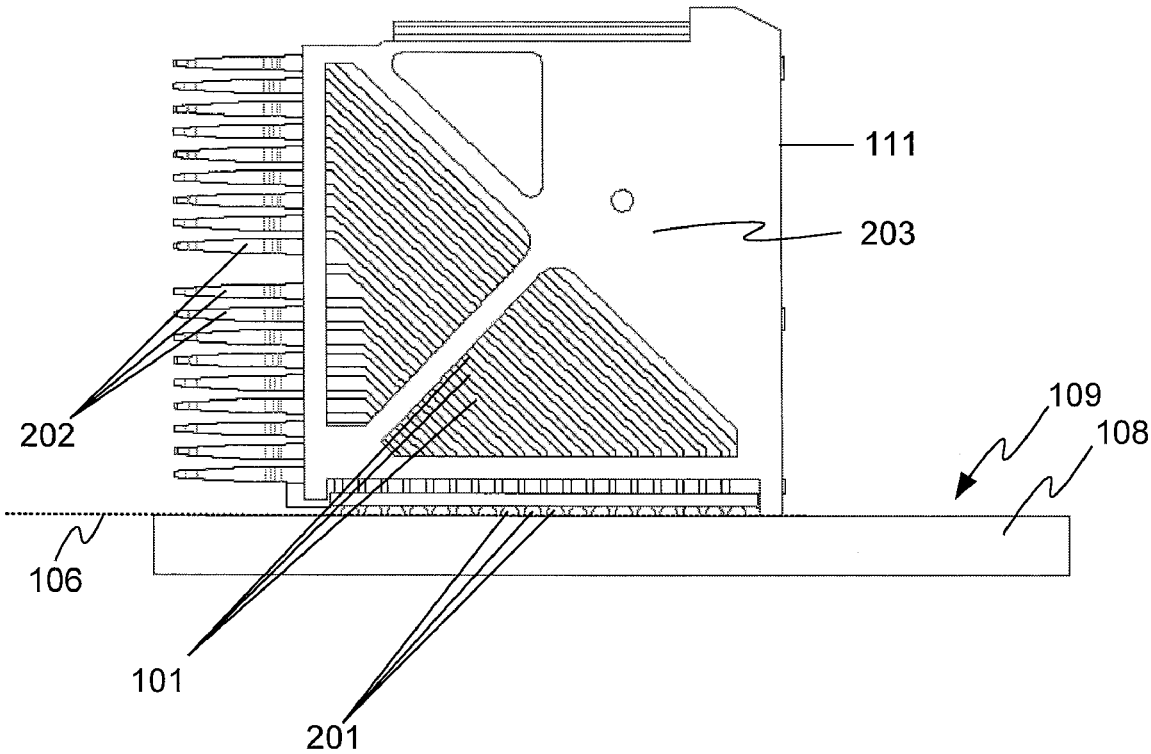

FIGS. 2A and 2B depict a plurality of IMLAs 111 mounted to a substrate 108 in isometric and side views, respectively. The IMLA may be defined as having an dielectric leadframe housing 203 through which one or more electrically conductive contacts 101 extends. The dielectric housing 203 retains the one or more electrically conductive contacts 101. The dielectric housing 203 may be insert molded over a leadframe of electrically conductive contacts. Each electrically conductive contact 101 may be made of electrically conductive material, such as metal for example.

Each electrically conductive contact 101 may include a mounting end 201 and a mating end 202. The mounting end 201 of the electrically conductive contact 101 may be in any configuration suitable for mounting to the substrate 108. For example, the mounting end 201 may be an eye-of-the-needle configuration. Also, for example, the mounting end 201 may include a solder ball connector thereto suitable for a ball grid array mount.

Figure 3:
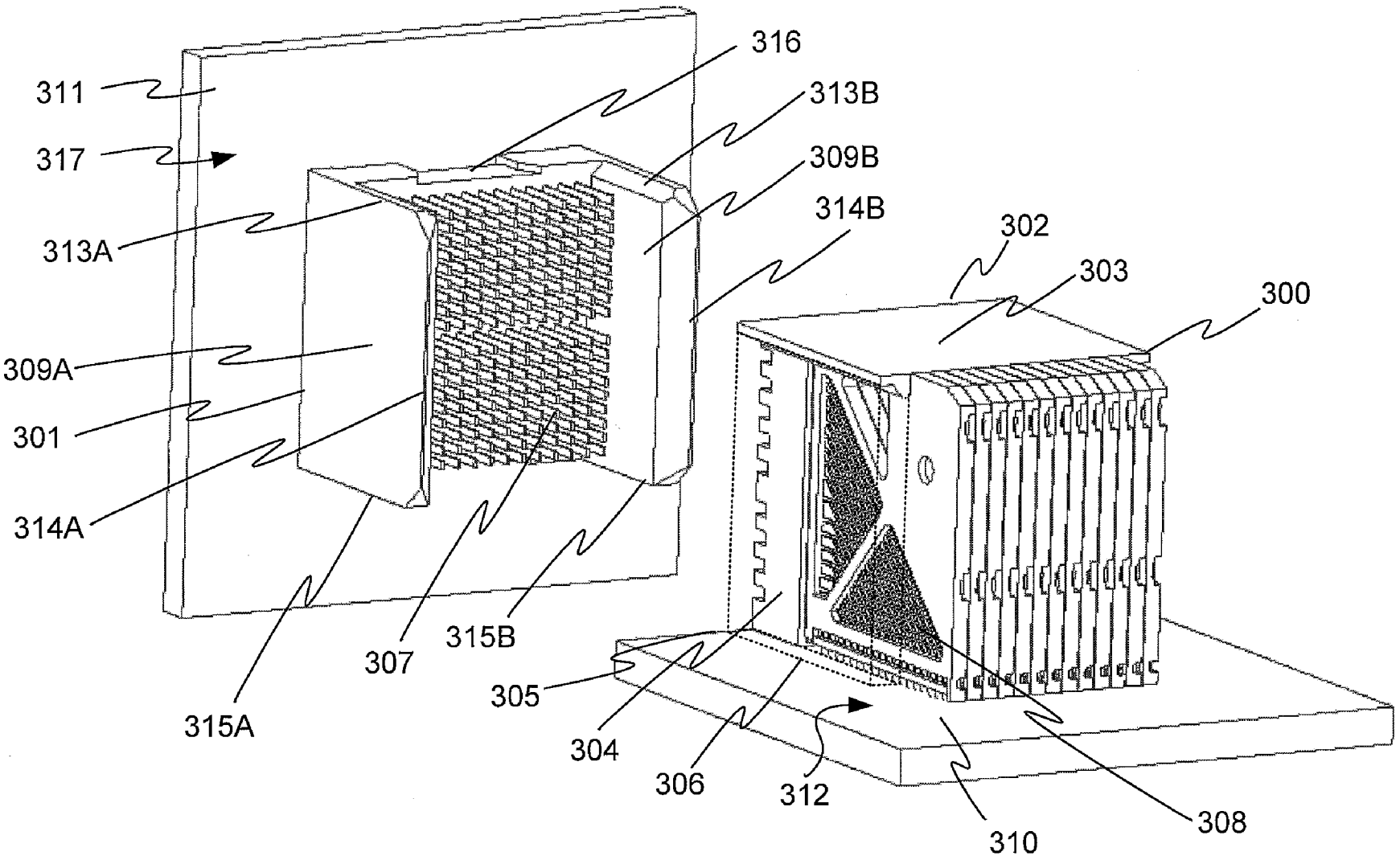
FIG. 3 depicts a right-angle electrical connector mounted to a first substrate and a complementary connector mounted to a second substrate that is perpendicular to the first substrate.

As shown in FIG. 3, the mating end 202 of electrically conductive contact 101 may be any configuration suitable for mating with a complementary connector 301. For example, the mating end 202 may be blade shaped or define a receptacle.

Suitable for a right-angle connector, the mating end 202 of the electrically conductive contact 101 may extend in a direction perpendicular to the mounting end 201 of the electrically conductive contact 101. For example, when the insert molded leadframe array 111 is mounted to the substrate 108, the mounting end 201 may be oriented perpendicular to a plane defined by the upper surface 109 of the substrate 108, and the mating end 202 may extend parallel to the plane defined by the upper surface 109 of the substrate 108.

Each electrically conductive contact 101 may be contained within the connector housing 102. The mating ends 202 of the contacts 101 may be received in a mating end 103 of the connector housing 102. The mounting ends 201 of the contacts 101 may be flush with the mounting plane 106.

FIG. 3 depicts a right-angle electrical connector 300 mounted to a first substrate 310 and a complementary connector 301 mounted to a second substrate 311 that is perpendicular to the first substrate 310. In one embodiment, the right-angle electrical connector 300 may be suitable for backplane applications. For example, the first substrate 310 may be a daughter board, and the second substrate 311 may be a backplane. In another embodiment, the complementary connector 301 may also be a right angle connector. For example, the complementary connector 301 may be a right-angle connector in a coplanar application.

In one embodiment, the right-angle electrical connector 300 may include a connector housing 302. The connector housing 302 may include a top portion 303 and a bottom portion 304. The bottom portion 304 may define a bottom surface (not shown) that abuts the upper surface 312 of the first substrate 310. Thus, the right-angle electrical connector 300 may define one or more receiving channels 306 between the top portion 303 and the upper surface 312 of the first substrate 310. The receiving channels 306 may be defined on opposite sides of the bottom portion 304. The right-angle electrical connector 300 may be oriented at an edge 305 of the first substrate 310, suitably oriented to receive the complementary connector 301.

The complementary connector 301 may be any connector suitable to mate with the right-angle electrical connector 300. The complementary connector 301 may include one or more electrically conductive contacts 307. Each electrically conductive contact 307 of the complementary connector 301 may be suitable for mating with the corresponding electrically conductive contact 308 of the right-angle electrical connector 300. For example, if the electrically conductive contact 308 of the right-angle electrical connector 300 includes a male lead, the corresponding electrically conductive contact 307 of the complementary connector 301 may include a female receptacle.

The complementary connector 301 may include one or more header walls 309A-B. The header walls 309A-B may be any feature or features of the complementary connector 301 adapted to provide guidance for mating the right-angle electrical connector 300 with the complementary connector 301. For example, the header walls 309A-B may be adapted to be received between the top portion 303 of the right-angle electrical connector 300 and the upper surface 312 of the first substrate 310.

In one embodiment, each header wall 309A-B may include a top edge 313A-B, a leading edge 314A-B, and a bottom edge 315A-B, for example. In one embodiment, the leading edge 314A-B and the top edge 313A-B may be chamfered to provide lead-in guidance when mating with the right-angle electrical connector 300. The leading edge 314A-B may include one or more horizontal chamfers and one or more vertical chamfers. The top edge 313A-B may be chamfered to correspond to the top portion 303 of the right-angle electrical connector 300, additionally providing polarization. Such polarization may ensure that the electrically conductive contacts 308 of the right-angle electrical connector 300 and the electrically conductive contacts 307 of the complementary connector 301 are mated properly. The bottom edge 315A-B may include a flat surface corresponding to the flat upper surface 312 of the first substrate 310. The flat surface at the bottom edge 315A-B may also prevent incorrect mating.

The complementary connector 301 may include a base portion 316. In a back panel application, the base portion 316 may define the spacing between the first substrate 310 and the upper surface 317 of the second substrate 311 when the right-angle electrical connector 300 mates with the complementary connector 301. Changing the thickness of the base portion 316 may allow for alternate back panel to daughter card spacing. For example, the thickness may be changed to provide FutureBus standard or hard metric standard spacing.

Figure 4B:
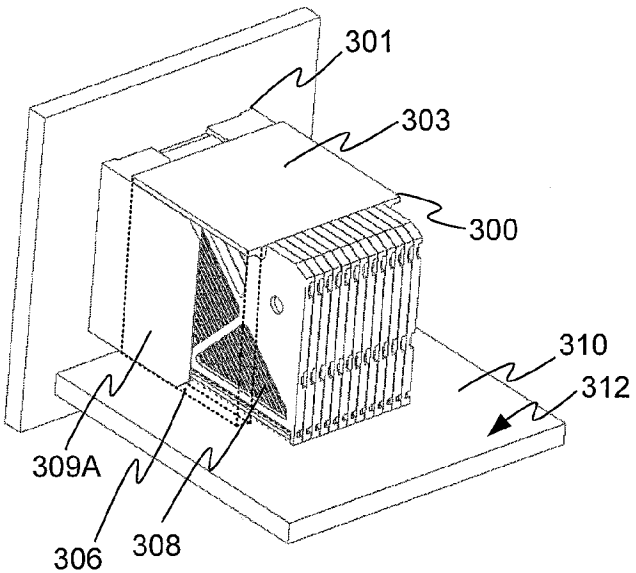
FIGS. 4A and 4B depict the mating of the right-angle electrical connectors shown in FIG. 3.
Figure 4A:
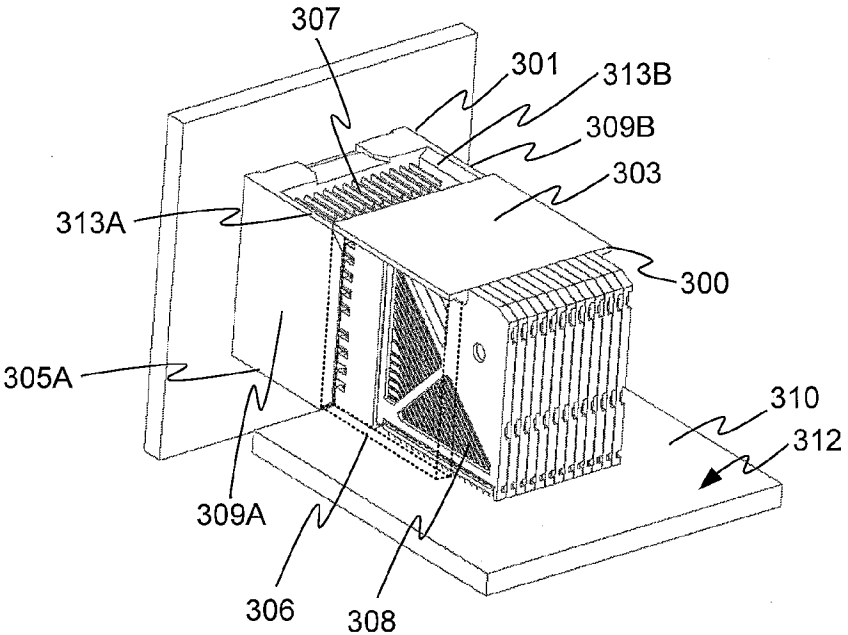

FIGS. 4A and 4B depict the mating of the right-angle electrical connectors shown in FIG. 3. When the right-angle electrical connector 300 and the complementary connector 301 are mated, each header wall 309A-B of the complementary connector 301 may be received between the top portion 303 of the right-angle electrical connector 300 and the upper surface 312 of the first substrate 310.

The top edge 313A-B of the header walls 309A-B may abut the top portion 303, and the bottom edge 315A-B of the header walls 309A-B may abut the upper surface 312 of the first substrate 3 10. Where the top portion 303 and the top edge 313A-B of the header walls 309A-B may be chamfered, the chamfer of the top edge 313A-B may engage the chamfers of the top portion 303. In one embodiment, the header walls 309A-B may be received by a receiving channel 306. When mating, the electrically conductive contacts 308 of the right-angle electrical connector 300 may be aligned with the electrically conductive contacts 307 of the complementary connector 301.

Figure 5:
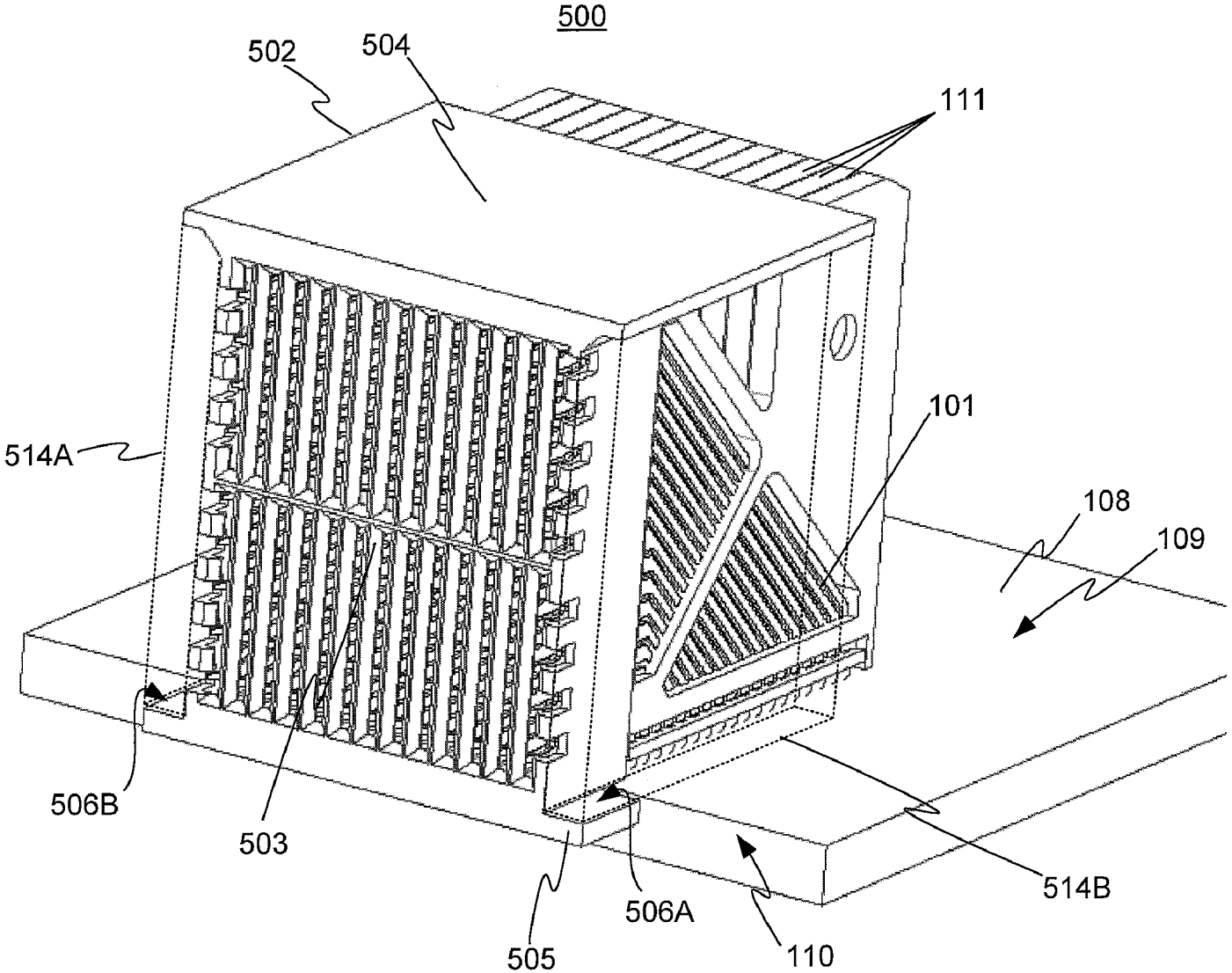
FIG. 5 depicts, in isometric view, a right-angle electrical connector mounted to a substrate.

FIG. 5 depicts, in isometric view, a right-angle electrical connector 500 mounted to a substrate 108. In one embodiment, the right-angle electrical connector 500 may include an electrically conductive contact 101 that defines a mounting end 201 and a mating end 202.

The right-angle electrical connector 500 may include a connector housing 502 including a mating portion 503 and a first guide portion 504. The mating portion 503 may receive the mating end 202 of the electrically conductive contact 101. The mating portion 503 may define a mating plane according to the face of the right-angle electrical connector 500 at which it mates with a complementary connector 301, as shown in FIG. 3. The mating portion 503 may also define a mounting plane. The mounting plane may be defined according to the face of the right-angle electrical connector 500 at which it mounts to the upper surface 109 of the substrate 108. The mounting plane may be perpendicular to the mating plane.

The first guide portion 504 may be connected to the mating portion 503. The first guide portion 504 may define a guide plane perpendicular to the mating plane. The first guide portion 504 may extend beyond the mating portion 503. The first guide portion 504 may define one or more voids 514A-B between the guide plane and the mounting plane. The voids 514A may be suitable for receiving a header walls 309A-B of a complementary connector 301 such as the connector 301 shown in FIG. 3.

In one embodiment, the mating portion may extend beyond the edge 110 of the substrate 108. The mating portion 503 may define a second guide portion 505. The second guide portion 505 may extend below the upper surface 109 of the substrate 108. The mating portion 503 may define a second guide portion 505. The second guide portion 505 may define an upper surface 506A-B flush with upper surface 109 of the substrate 108. The upper surface 506A-B of the second guide portion 505 may be flush with the mounting plane.

What is claimed:

1. A right-angle electrical connector for mounting on a substrate, the right-angle connector comprising:

an electrically conductive contact that defines a mounting end and a mating end;

a connector housing that contains the contact, the connector housing having a mating end configured to mate with a complementary electrical connector, the mating end of the connector housing defining a mating plane;

wherein (i) the mating end of the contact is a blade configured to be received in a complementary receptacle, and is disposed in the mating end of the connector housing; and (ii) the mating plane is flush with an edge of the substrate when the connector is mounted on the substrate, and the connector housing is configured to contact the substrate at a lower portion of the mating end when the connector is mounted on the substrate, wherein the connector housing comprises a mounting plane that extends perpendicular to the mating plane, and the connector housing further comprises a guide portion that is connected to the mating end of the connector and defines a guide plane that is perpendicular to the mating plane, wherein the guide portion defines a first void between the guide plane and the mounting plane, wherein the first void between the guide plane and the mounting plane receives a header wall of a complementary connector.

2. The connector of claim 1, wherein the guide portion is chamfered.

3. The connector of claim 1, wherein the guide portion defines a second void between the guide plane and the mounting plane.

4. The connector of claim 1, wherein an insert molded leadframe retains the contact.

5. The connector of claim 1, further comprising a plurality of contacts each having a mounting end, wherein the mounting ends of the contacts comprise a ball grid array.

6. The connector of claim 1, wherein the mounting plane is flush with the is flush with the substrate when the connector is mounted on the substrate.

7. The connector of claim 1, wherein the substrate comprises opposing upper and lower surfaces, and an edge surface connected between the upper and lower surfaces, and the mating plane is flush with the edge surface when the connector is mounted on the substrate.

8. The connector of claim 1, wherein the lower portion of the mating end defines a substantially flat mating face that is coplanar with the mating plane.

9. The connector of claim 1, wherein the guide portion extends beyond the mating plane.

10. A right-angle electrical connector configured for being mounted on a substrate, the right-angle electrical connector comprising:

an electrically conductive contact that defines a mounting end and a mating end;

a connector housing that contains the contact, the connector housing comprising:

a mating portion that receives the mating end of the contact, wherein the mating portion defines a mating plane, and the mating plane is flush with an edge of a substrate when the connector is mounted on the substrate; and a guide portion that is connected to the mating portion and defines a guide plane that is orthogonal to the mating plane, wherein the guide portion extends out from a side of the housing, wherein the mating portion defines a mounting plane orthogonal to the mating plane and flush with the substrate, wherein the guide portion defines a first void between the guide plane and the mounting plane, wherein the guide portion defines a second void between the guide plane and the mounting plane.

11. The connector of claim 10, wherein the guide portion is chamfered.

12. The connector of claim 10, wherein the guide portion provides an upper guide surface, and the substrate provides a lower guide surface when the connector is mounted on the substrate.

13. The connector of claim 10, wherein the connector housing is configured to contact the substrate at a lower portion of the mating end when the connector is mounted on the substrate.

14. The connector of claim 13, wherein the lower portion of the mating end defines a substantially flat mating face that is coplanar with the mating plane.

15. A connector housing for a right-angle electrical connector, the connector for mounting to a substrate, the substrate defining an upper surface, the connector housing comprising:

a top portion; and a bottom portion opposite the top portion, the bottom portion defines a bottom surface;

wherein, when the electrical connector is mounted to the substrate, (i) a first receiving channel is disposed between the top portion of the connector housing and the upper surface of the substrate; and (ii) the bottom surface of the bottom portion of the connector housing abuts the upper surface of the substrate, wherein the substrate defines a lower surface, and an edge connected between the upper and lower surfaces, the connector housing further comprises a mating end configured to mate with the complementary electrical connector, and the mating end defines a mating plane that is flush with the edge of the substrate when the right-angle electrical connector is mounted to the substrate.

16. The connector housing of claim 15, wherein the top portion is chamfered.

17. The connector housing of claim 15, wherein the first receiving channel receives a header wall of a complementary connector.

18. The connector housing of claim 15, wherein, when the electrical connector is mounted to the substrate, a second receiving channel is defined between the top portion of the connector housing and the upper surface of the substrate.

19. The connector housing of claim 18, wherein the first receiving channel and the second receiving channel are defined on opposite sides of the bottom portion.

20. The connector housing of claim 15, wherein the bottom portion of the housing defines a mating end flush with an edge of the substrate.

* * * * *